United States Patent [19]

Dingess

[11] Patent Number: 5,063,883

[45] Date of Patent: Nov. 12, 1991

[54] DETONATION CONTROL DEVICE FOR AN INTERNAL COMBUSTION ENGINE

[76] Inventor: Billy E. Dingess, 117 Rail Road Ave., Ferrellsburg, W. Va. 25524

[21] Appl. No.: 487,256

[22] Filed: Mar. 2, 1990

Related U.S. Application Data

[63] Continuation-in-part of Ser. No. 299,543, Jan. 19, 1989.

[51] Int. Cl.[5] ..... F02B 75/04

[52] U.S. Cl. ..... 123/48 R; 123/48 AA

[58] Field of Search ..... 123/48 R, 48 A, 48 AA, 123/48 D, 78 R, 78 D

[56] References Cited

U.S. PATENT DOCUMENTS

| | | | |
|---|---|---|---|
| 2,420,117 | 5/1947 | Weathrup | 123/48 AA |

FOREIGN PATENT DOCUMENTS

| | | | |
|---|---|---|---|
| 3117133 | 11/1982 | Fed. Rep. of Germany | 123/48 AA |
| 929620 | 1/1948 | France | 123/48 A |
| 2539457 | 7/1984 | France | 123/48 D |
| 868075 | 10/1981 | U.S.S.R. | 123/48 R |

*Primary Examiner*—Noah P. Kamen

[57] ABSTRACT

The invention is directed towards adjusting the combustion ratio of an internal combustion engine. The apparatus has a compensator piston which is selectively hydraulically positioned. The piston is linked to a shock adsorber so as to keep the combustion chamber charge from reaching the pressure detonation limit.

9 Claims, 6 Drawing Sheets

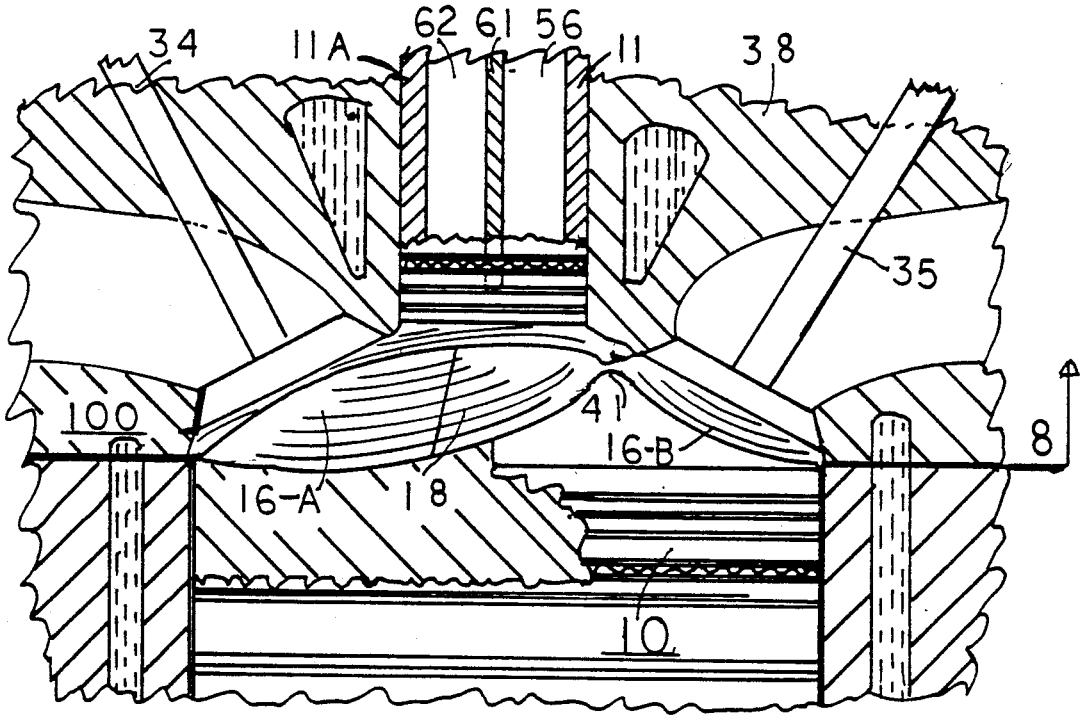
FIG.——7
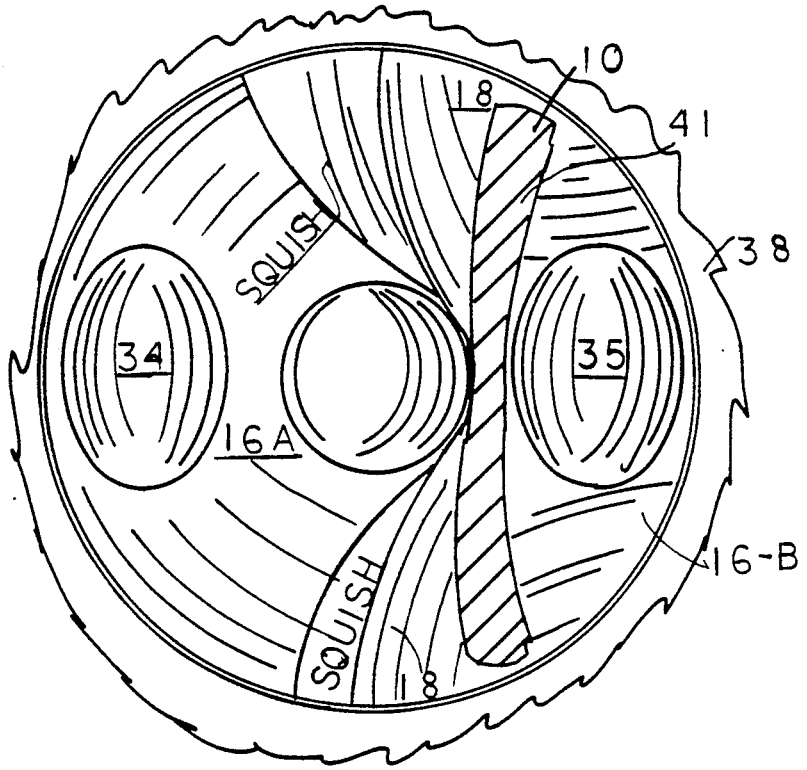
FIG.—— 8

DETONATION CONTROL DEVICE FOR AN INTERNAL COMBUSTION ENGINE

This invention is a continuation in part of application entitled, An Internal Combustin Engine End Gas Pressure Absorbing Apparatus Filed 1-19-89 Ser. No. 07/299,543.

BACKGROUND OF THE INVENTION

This invention relates to a compensator system with a compensator piston in the engine head with the purpose of the invention being first to provide a predetermined low compression ratio hereinafter referred to as a C.R. near the level commonly used for auto engines (near 9 to 1), and a very high C.R. near 15 to 1. The compensator system controls detonation with the engine operating at the high C.R. The C.R. can be changed from high to low for starting the engine in cold weather, and from low to high with the engine warmed up. A cooling system circulates water around the piston cylinder wall and circulates oil within the piston. A hydraulic return shock absorber slows the piston return speed to prevent noise and vibrations as the piston is returned to rest position.

The engine can be operated with low octane gasoline, methanol, or ethanol fuels.

PRIOR ART

U.S. Pat. No. 2,914,047 shows a piston in the head of the engine but was not used to control detonation. The patent discloses lowering the C.R. from 8 to 4 by providing two predetermined C.R.'s for the engine, and the head piston reacts more to the compression stroke than the power stroke of the engine.

An Italian Pat. No. 498,735 shows a piston in the head of an engine with a spring as a medium between the piston and engine head. This invention uses the piston to provide better scavenging and reacts before T.D.C. (top dead center).

German Pat. 25-37221 and Patent DE 3409-617-A show a piston in the head on an engine. No structure is shown by either of the patents to control the piston return speed to prevent shock and noise as the piston is returned to the piston seat.

The purpose of these inventions is in part to provide better scavenging for the engine, and using the maximum cylinder pressure to provide more torque by transferring high pressure near T.D.C. to a more desirable crank angle; all of which indicates that the piston begins to respond before T.D.C. and this would have the effect of lowering the C.R. This would also cause more piston motion during combustion thus reducing the thermal efficiency of the engine.

The gas medium shown by each of these inventions between a compensator piston and head would be nearly impossible to seal by the piston rings and the combustion chamber. The spring pressure cannot be controlled for varying compression ratios except the change made by response to the head piston.

PURPOSE OF THE INVENTION

In order to increase the thermal efficiency of a spark ignition engine with the use of a compensator piston housed within the engine head: (1) the C.R. of the engine must be raised; (2) the compensator piston movement must be controlled by the engine spark timing in conjunction with the engine gas pressure or engine inlet pressure; which is normally after top dead center (hereinafter referred to as A.T.D.C.) except during heavy engine loads where the piston may respond a few crank degrees before T.D.C. to avoid detonation; and, (3) the combustion chamber is designed wherein the piston is forced to respond very rapidly near T.D.C. to prevent added piston motion (head piston and engine piston motion) to prevent a loss of power due to the added piston motion during combustion.

This invention will show how the C.R. of spark ignition engine can be raised to near 15 or 1 but below the detonation limit.

Detonation within the spark ignition engine is caused by high end gas pressure and temperature. The manner of controlling detonation normally, is to provide a C.R. low enough that the pressure and temperature do not rise high enough to cause the end gas to detonate, normally at the end of pressure rise within the engine cylinder. An automatic spark advance is provided so that when the engine is throttled and the engine inlet pressure is raised, the spark will be retarded, thus causing the maximum combustion pressure to be lower and take place at a later crank angle.

If the C.R. could be raised without causing pressure detonation while holding the spark constant, except for advancing the spark as engine speed increases, to allow for a longer lag time during combustion, then a more thermally efficient engine would result.

By providing a small compensator piston within the engine head which responds to the cylinder pressure, energy is stored during a period of rapid pressure rise within a compressible medium defined as being after T.D.C. During low inlet pressures such as idling or light loads, the piston would not respond at all, but when the engine is throttled thus increasing the inlet pressures, the compensator piston would react to limit the maximum cylinder pressure by increasing the combustion chamber volume during combustion time and decreasing the volume after combustion is complete which would have almost the same effect on detonation as retarding the spark but without the loss in efficiency caused by retarding the spark.

OBJECTIVES WITH THE INVENTION

1. To provide an engine with a C.R. high enough to use methanol or ethanol fuels and to use low octane gasoline (87) without detonation.

2. To provide a way of storing energy produced from the higher C.R. in excess of the energy produced from the conventional ratio during a period from near T.D.C. to the maximum cylinder pressure or end of combustion, and returning energy during the remaining power cycle of said engine.

3. To provide a way of operating the engine at any point between a high C.R. and a low C.R., and changing the operating C.R. while the engine is running.

4. To provide a compensator piston within the head of the engine with an engine combustion chamber that squeezes the fuel/air mixture to the area near the compensator piston to cause a very rapid reaction of the compensator piston near or after top dead center of the engine power cycles and to provide a way of reducing the engine's end gas compression time (the time A.T.D.C. wherein the gas is compressed due to the rising temperature as the flame front moves through the last part of the charge, defined herein as the period of rapid pressure rise).

BRIEF DESCRIPTION OF THE DRAWINGS

FIG. 7 shows an isolated section of the invention to illustrate an arrangement of the engine valves in relation to the invention.

FIG. 8 is taken from Line 8 of FIG. 7

DETAILED DESCRIPTIONS OF THE INVENTION

Figure 1:
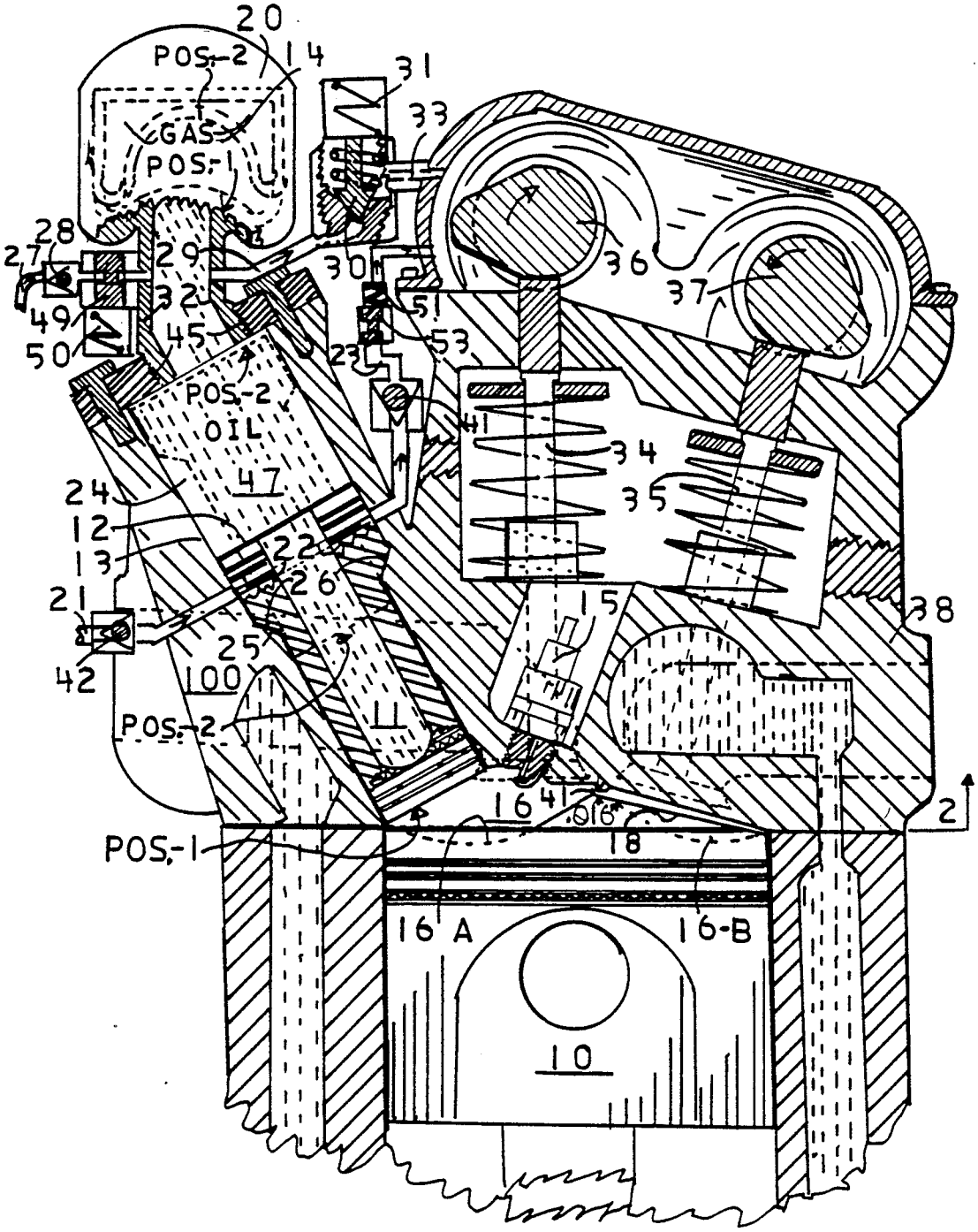
FIG. 1 shows a sectioned part of an engine taken from a direction parallel to the crank shaft.
Figure 2:
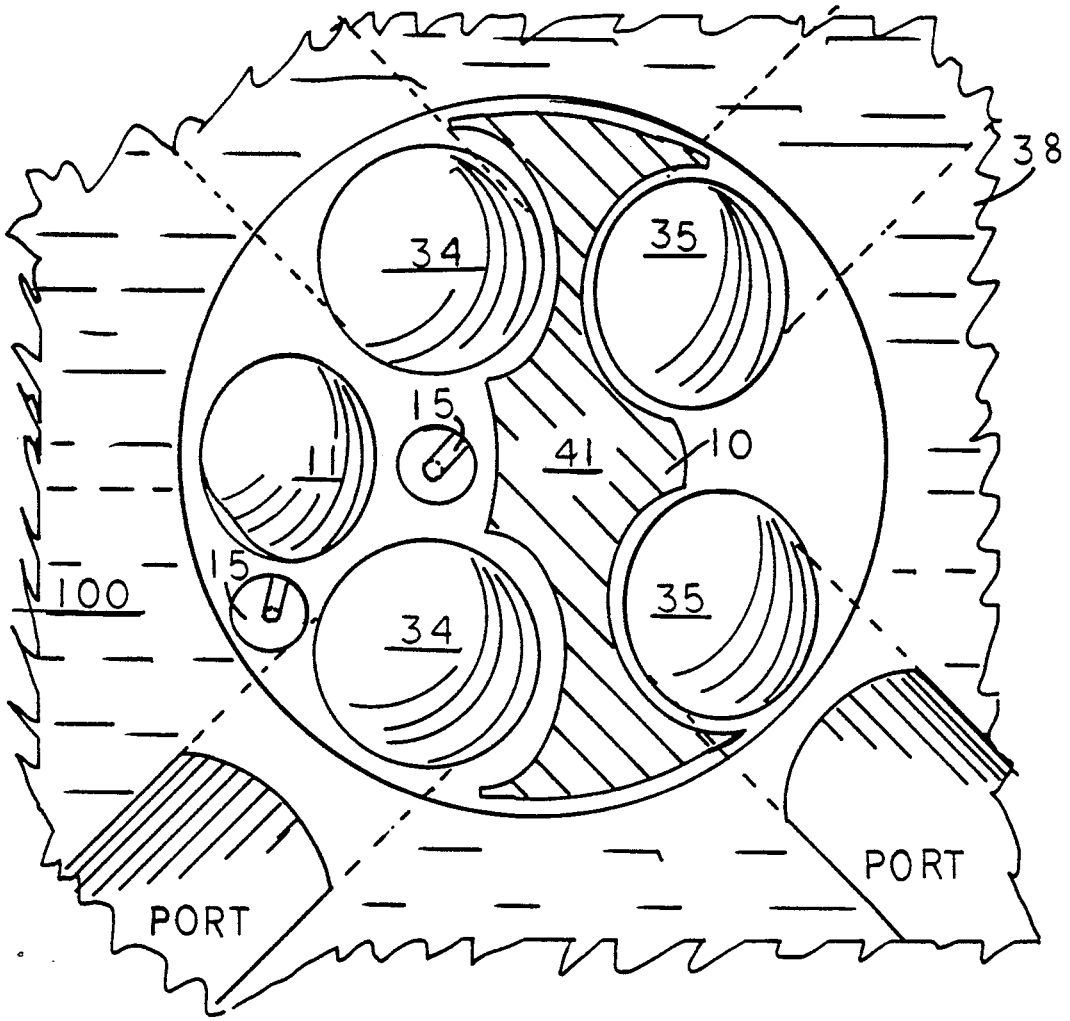
FIG. 2 is taken at Line 2 of FIG. 1.
Figure 3:
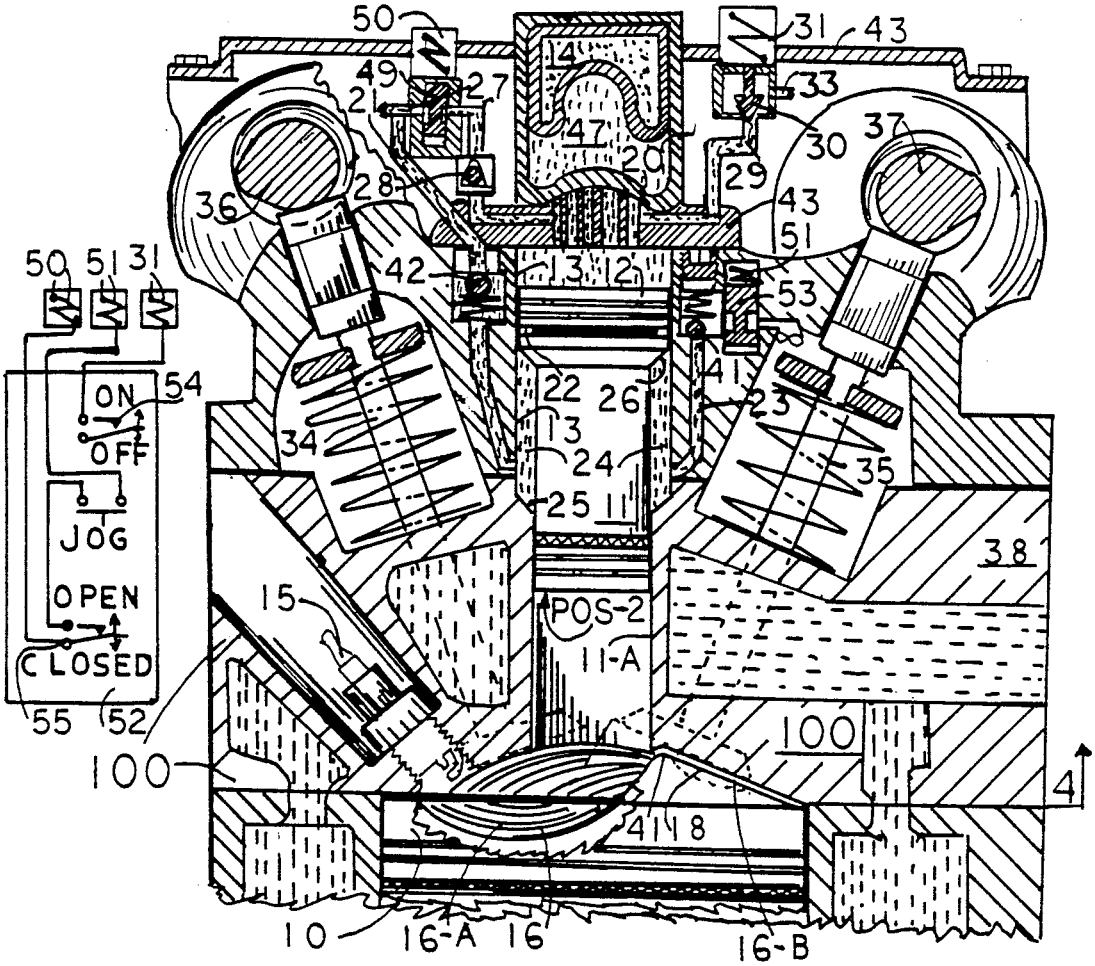
FIG. 3 is a different species taken from the same location as FIG. 1.
Figure 4:
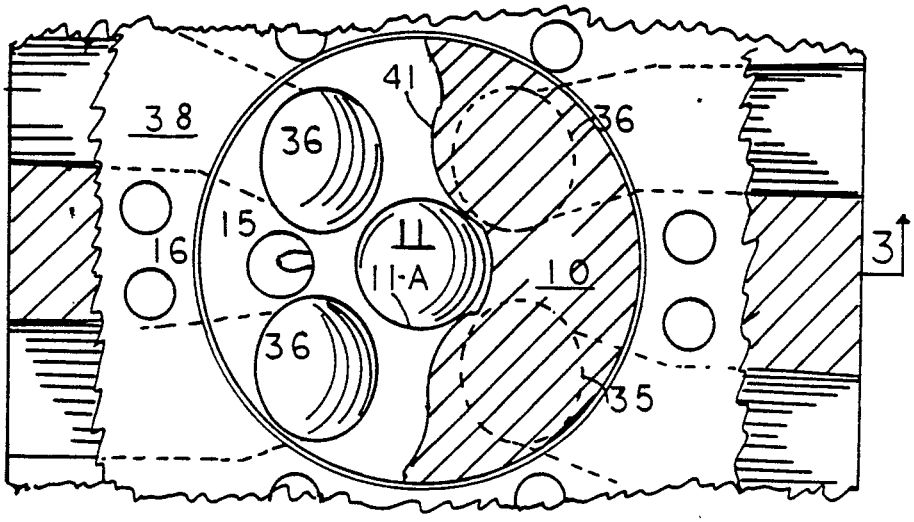
FIG. 4 is taken from Line 4 of FIG. 3.

FIG. 1 and FIG. 3 show the arrangement of the valves 34 and 35 and twin cam shafts 36 and 37 with 4 valves per cylinder shown by FIG. 2 and FIG. 4 and how they are located within engine 5 head 38 with reference to the compensator piston 11 and the engine piston 10.

A head cylinder 100 comprises cylinders 11-A and 13.

A compensator piston 11 is housed within compensator cylinder 11-A extending through head 38 with one end of piston 11 forming a part of combustion chamber 16. The compensator cylinder extends from combustion chamber 16 to a tapered cylinder seat 25 where a second cylinder is formed and will be referred to as, a compensator cylinder 11-A and displacement cylinder 13. Likewise the compensator piston 11 is linked by way of piston seat 26, to an enlarged base 12.

The engine combustion chamber 16 is partially divided by chamber 16-A and 16-B. The piston 11 and spark plug 15 are located within chamber 16-A, with the spark plug 15 located near piston 11. A raised segment 41 of piston 10 has a small clearance between segment 41 and head 28 and will divide chamber 16-A and 16-B near T.D.C. of piston 10. Chamber 16-B will comprise no more than one third the total combustion chamber as shown by FIG. 1 and, no less than the valve 35 clearance between valve 35 and piston 10, to form a squish area 18 as shown by FIG. 3. The chamber 16-B will be referred to as the squish chamber 16-B.

A first chamber 16-A comprises an area wherein inlet valve or valves 34, piston 11, and spark plug 15 are located. A small chamber 16-B comprises an area wherein exhaust valve 35 is located. during combustion near T.D.C. the pressure will rise faster within chamber 16-A than it can be transferred to chamber 16-B due to the limited clearance between segment 41 of piston 10 and head 38. This will cause an unbalanced pressure against piston 10 but should have no noticeable effect to cause binding of piston 10 due to piston 10 being located near T.D.C., defined as $-5°$ B.T.D.C. (before top dead center) to $+5°$ A.T.D.C. wherein little piston 10 motion takes place. At $-5°$ or $+5°$ crank degrees the clearance between segment 41 and head 38 will be increased to balance the pressure between chamber 16-A and 16-B.

An engine oil supply line 21 is linked with the engine oil pump (not shown) that supplies oil to piston 11. An oil groove 22 is machined around base 12 below sealing rings 70. An oil hole 59 allows oil to be passed to chamber 62, and by way of baffle 61 oil is passed to the bottom of piston 11, through baffle holes 60, to chamber 56, and out hole 57, to groove 22 and through line 23. A check valve 42 is in line 21. Another check valve 41 is in line 23. The oil is then forced to flow from valve 42 to shut off valve 53 operated by solenoid 51. The oil passing through chamber 62 and out chamber 56 acts to cool piston 11. Engine coolant is circulated around the outside of cylinder 11-A to further cool piston 11.

Figure 5:
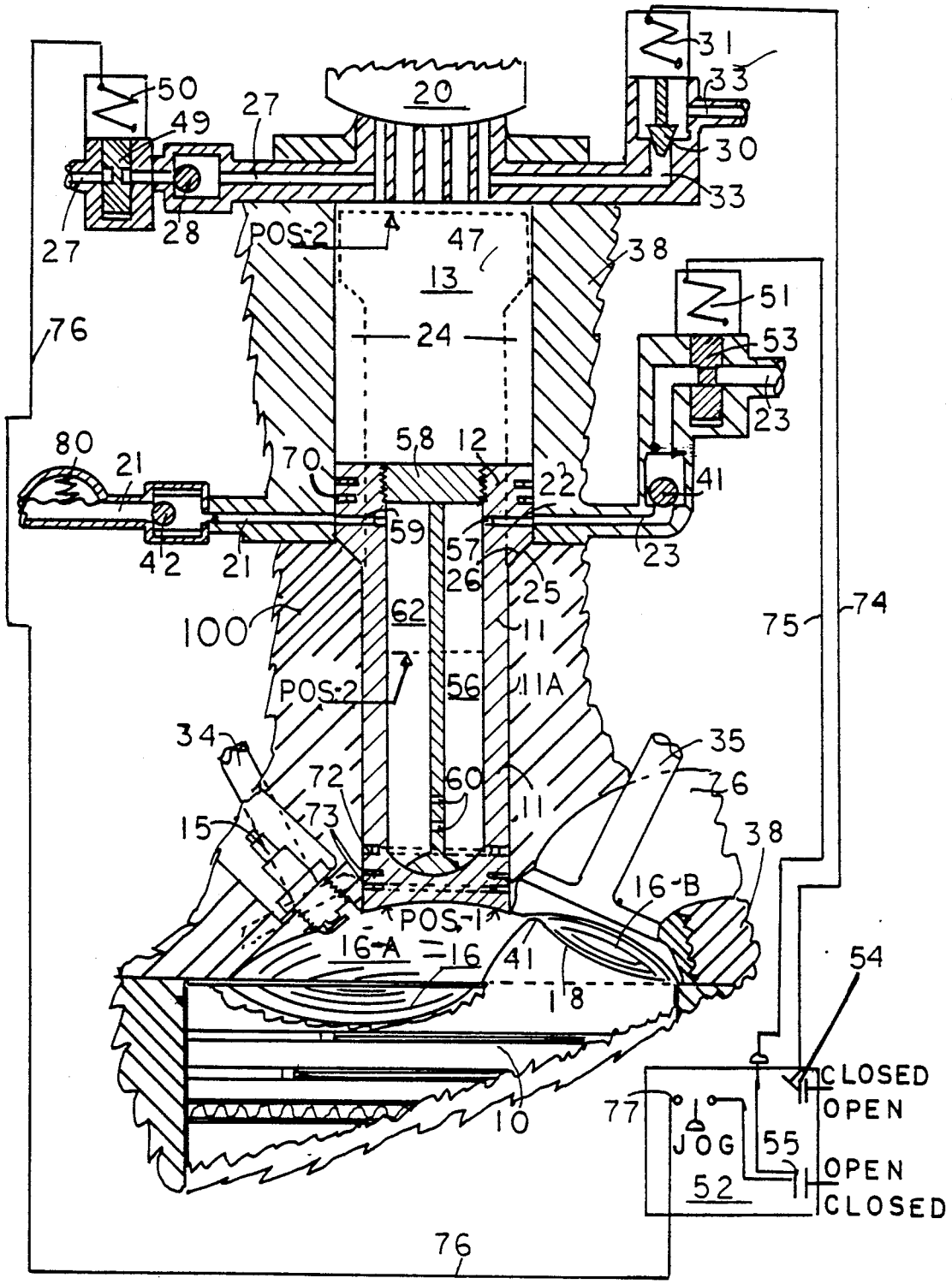
FIG. 5 is an isolated view of the invention taken from Line 3 of FIG. 4.

Cylinder 13 is used to house oil between a nitrogen charged damper 20, and base 12. The oil 47 is supplied oil by engine oil pump (not shown) through line 27, through shut off valve 49 operated by solenoid 50, around check valve 28, with line 27 passing oil to fill cylinder 13. Oil is then passed through line 33 to an electrically opened spring loaded bypass valve 30. In the closed position as shown by FIG. 5, valve 30 is preset to a predetermined bypass pressure that will bypass oil from cylinder 13 at certain operating conditions of engine 5. Piston 11 comprises at least one oil ring 72 and at least two compression rings 73. Oil is supplied by way of oil groove 22 which directs oil between cylinder 11-A and piston 11 to oil ring 72 to lubricate piston 11. A plug 58 and sealing rings 70 separate the oil 47 from the oil passed through line 21 to line 23. The piston 11 normally rests at position 1 hereinafter referred to as Pos. 1 as shown by FIG. 5 and is moveable within cylinder 11-A to a fully retracted position, referred to as position 2 (hereinafter referred to as Pos. 2) shown by the dashed lines of FIG. 5 and shown fully by FIG. 3. The displacement of cylinder 11-A, when positioned in the fully retracted Pos. 2 would be equal to the C.I.D. (cubic inch displacement) of the fixed combustion chamber of engine 5 defined as the displacement when engine piston 10 is located at T.D.C., and the compensator piston located at Pos. 1. For example, an engine cylinder has a maximum cylinder volume of 30 C.I.D., and a minimum volume at T.D.C. of 2 C.I.D. which equals a 15 to 1 C.R., and with the piston 11 retracted to Pos. 2, the master cylinder 11-A would equal 2 cubic inches displacement, or 7.5 to 1 C.R.

During cold weather, starting problems with 15 to 1 C.R.s will arise, but not at 7.5 to 1.

Valves 49 and 53 are normally open and valve 30 closed. A remotely located switch circuit 52 comprises a switch 54, connected to solenoid 31, by way of line 74 and when placed in the open position valve 30 will open allowing oil to flow from slave cylinder 13. Switch 55 is placed in the closed position and solenoids 50 and 51 will close valves 49 and 53. Oil pressure will then be forced between cylinder 11-A, seat 25 and piston seat 26, (shown by FIG. 3) to within chamber 24, with chamber 24 being formed in response to master piston 11 taking Pos. 2. The piston 11 will also be directed to Pos. 2 in response to compression pressure caused by piston 10 on the compression stroke. The check valve 42 will then hydraulically lock piston 11 at Pos. 2. With switch 54 in the closed position, and by pressing jog switch 77 in, valve 49 and valve 53 will open wherein piston 11 can be forced by way of oil pressure within line 27 to take any position between Pos. 1 and Pos. 2. When the jog switch 77 is released the piston 11 will be locked between oil medium 47 and oil within chamber 24. If any movement of piston 11 takes place by compressing bladder 14 then oil will be forced into chamber 24 to lock the piston 11 at the position the piston may be forced to take. The desired C.R. should be set before the engine is shut down but can be set as has been described. After starting the engine 5, if switch 54 is placed in the closed position and switch 55 in the open position, oil will be forced through check valve 28, and with the preset pressure relief valve 30 in the closed position, slave piston 12 will force piston 11 to again take Pos. 1 for the high C.R.

Shown by FIG. 1, the piston 11 is housed to the left of valves 34 and 35. A damper 20 having a nitrogen pressurized bladder 14 is linked to cylinder 13 by way of pipe 32 threaded at 45 to cap 43, wherein damper 20 could be isolated from slave cylinder 13 if desired. Shown by FIG. 3, the reaction piston 11 is housed between valves 34 and 35, with damper 20 bolted directly to slave cylinder 13 by way of cap 43. FIG. 7 shows where valves 34 and 35 are used with the engine, and FIG. 8 shows how the valves, spark plug and piston 11 are arranged within combustion chamber 16-16-A and 16-B.

FIG. 7 further shows a squish area 18 in addition to squish chamber 16-B, and acts to further squeeze the fuel/air mixture inwardly toward valve 34 and piston 11 to within chamber 16-A. The raised segment 41, of piston 10 and the squish area 18, should have a clearance between head 38 and piston 10 near 0.004" for each inch diameter of piston 10. A 4" diameter would require 0.016" clearance when piston 10 is located at T.D.C.

The damper 20 will require a displacement of no less than two times the displacement of cylinder 13 when reaction piston 11 is located at Pos. 1. The precharged pressure of damper 20 should equal by ratio the predicted combustion chamber pressure occurring when engine 5 is operating at near full load and engine piston 10 located at T.D.C. on the power cycle of engine 5 (250 P.S.I. (pounds square inch) to 300 P.S.I.). Damper 20 pressure would be twice as much with the piston 11 at Pos. 2 than at Pos. 1, the preset pressure.

The piston 11 should have a diameter of no less than $\frac{1}{4}$ and no more than $\frac{1}{3}$ the diameter of engine piston 10. FIG. 1 and FIG. 3 show oil filling the bottom of piston 11, but the oil would not circulate from cylinder 13.

Figure 6:
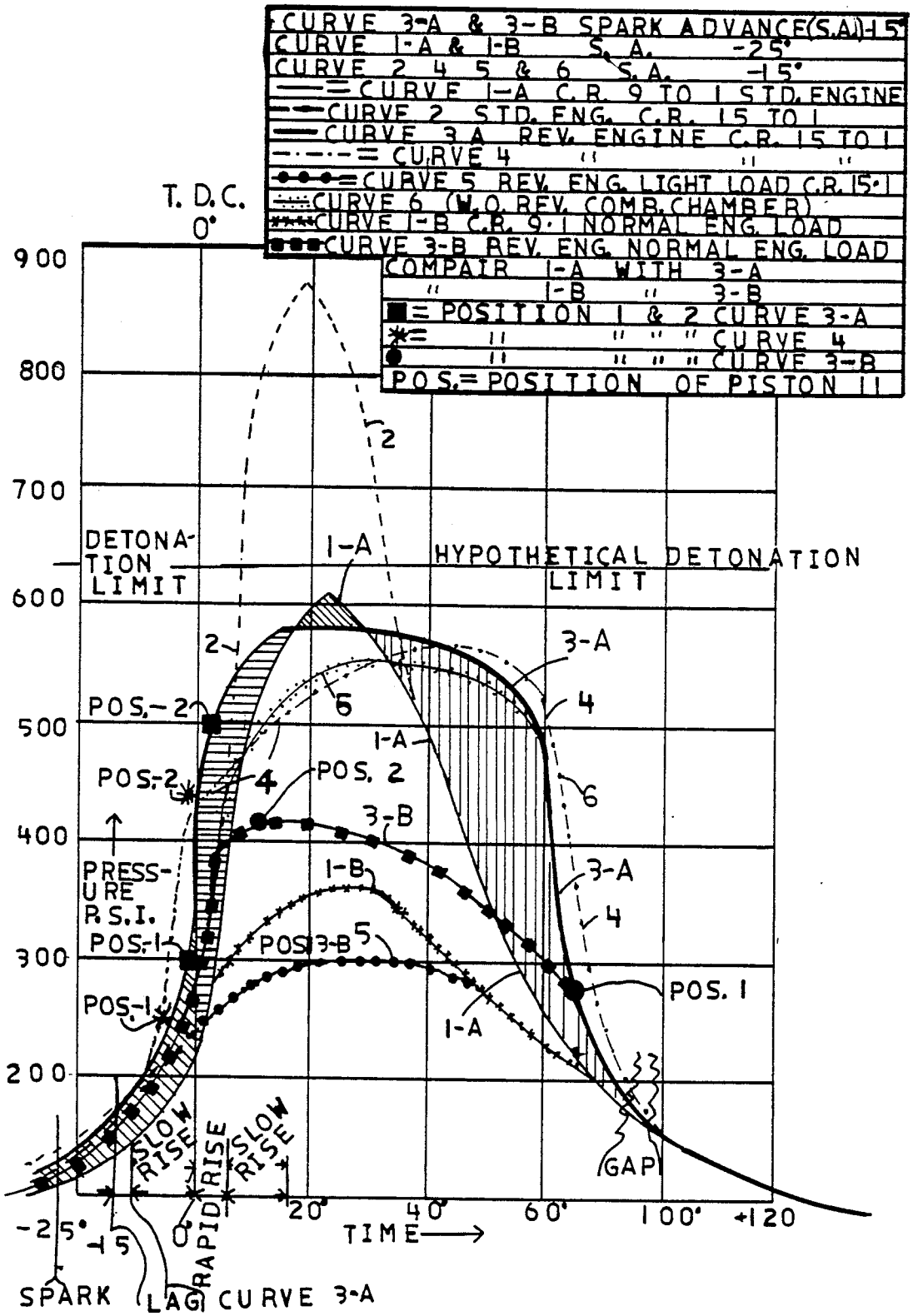
FIG. 6 shows pressure/time curves and shows how the invention effects the pressure/time curve.

In operation and beginning on the compression cycle of engine 5 the piston 10 would move to compress the fuel/air mixture to near 15° B.T.D.C. or where the best power spark advance would take place. A period of lag time followed by a period of slow pressure rise would raise the engine cylinder pressure to 250 to 300 P.S.I., at T.D.C. using 15 to 1 C.R., depending in part on the engine inlet pressure. Somewhere near or after T.D.C., the engine cylinder pressure will exceed the preset pressure within bladder 14 at which time piston 11 will begin to respond, as shown by FIG. 6, curve 3-A, assuming that engine 5 throttle is fully open, with engine at near full load. Due to the fixed geometry of piston 10 and head 38 the majority of fuel/air is squeezed toward the piston 11 and spark plug 15. The motion of piston 11 will cause turbulence within chamber 16-A which will cause the fuel to burn very rapidly. The pressure will rise within chamber 16-A faster than it can be transferred to chamber 16-B due to the raised segment 41;, thus the master piston 11 will be forced very rapidly to take Pos. 2 shown in FIG. 6 as beginning near 2° B.T.D.C. and ending near 5° A.T.D.C., with the pressure rising from 300 P.S.I. to 500 P.S.I. during 7 crank degrees. As the clearance between segment 41 becomes greater, the pressure within chamber 16-A and chamber 16-B causing a slow pressure rise to complete the combustion process near 15 degrees A.T.D.C. The energy produced during the rapid period of pressure rise is then stored in the form of potential energy within bladder 14, and as piston 10 is moved further on the power cycle, the bladder 14 will force piston 11 to again take Pos. 1 at the pressure, piston 11 responding near 65° A.T.D.C. shown as curve 3-A, of FIG. 6.

Referring back to FIG. 3, as piston 11 is forced to take Pos. 2, a partial vacuum is formed within chamber 24 between cylinder seat 25 and piston seat 26, and in conjunction with said vacuum and engine oil pressure, oil will be forced to within chamber 24, through line 24, around check valve 42, and as piston 11 is returned through force from bladder 14, oil will be forced from chamber 24 by way of line 23, around check valve 41, to the point where line 23 leaves chamber 24, wherein oil will be trapped between cylinder seat 25, and piston seat 26. The segment of piston 12 between oil groove 22 and seat 26 provides a clearance sufficient to provide a hydraulic shock absorber to prevent noise and vibrations as piston 11 is rapidly returned to said piston seat. This is a very important part of the invention because the vibrations caused from the piston 11 return are strong enough that they will otherwise cause the spark plug to crack and cause misfiring. Moreover, the piston 11 would act like a pneumatic hammer if without checking of the piston 11 return speed. A diaphragm damper 80 is located in front of check valve 42 that stores oil from the engine oil pump to provide a ready oil supply as piston 11 is moved from seat 25. The diaphragm 80 could be located on the return line 23 between check valve 51 and oil groove 22 to speed up the delivery of oil to chamber 24.

Another important feature of the invention is to use the response of piston 11 to control detonation in preference of retarding the spark by use of conventional automatic spark control. The piston 11 will automatically respond to varying inlet pressures and engine loads by reducing the fixed C.R during high inlet pressure and heavy loads, thus limiting the maximum cylinder pressure below the detonation limit.

The automatic spark control (now shown) should function to automatically advance spark timing to allow for a longer lag combustion time as engine R.P.M.'s (revolutions per minute) are increased. It should further comprise an engine idle communication between an electric solenoid having a mechanical linkage to the ignition distributor that will retard the spark during idle speed of engine 5. While the spark control could be used to retard the spark in response to engine 5 inlet pressures, the response of piston 11 should be first considered, then if the engine detonates, to use a sound comminution to the distributor to further retard the spark as is commonly used for auto engines.

The spark or injector timing of the engine should be timed to correspond with the piston 11 response pressure with the response of piston 11 set for normal engine loads to respond near 5° after T.D.C. During very heavy engine loads and maximum engine inlet pressure the piston 11 would then respond near 5° before T.D.C. thus having the effect of lowering engine 5 C.R. to avoid detonation.

FIG. 6 shows the effects of the invention at different inlet pressures, loads, and R.P.M.'s of a conventional engine as curve 1-A, and comparison of a conventional engine with an engine 5 equipped with the gas pressure reaction device.

Curve 1-A shows a typical pressure/time curve for an engine having a 9 to 1 C.R. with a heavy load at normal R.P.M. spark advanced −25° B.T.D.C. with the maximum pressure rise taking place at +25° A.T.D.C., operating at just below the detonation limit with combustion time from −25° to +25°. This is considered to be the best power spark advance with combustion 50 crank degrees.

Curve 2 shows an engine at 15 to 1 C.R. with combustion time from −15° before T.D.C. to −15° A.T.D.C. or 30 crank degrees with the engine far above the detonation limit.

Curve 3-A shows the improved engine 5 with the same inlet pressure (14.7 P.S.I.) as curve 1 and at the same R.P.M. with a heavy load. The spark advance is −15° B.T.D.C. The piston 11 begins to respond at −2.5° B.T.D.C. indicated as Pos. 1 with a rapid rise in pressure to +5° A.T.D.C. indicated as Pos. 2 followed by a slow pressure rise from +5° A.T.D.C. to +15° A.T.D.C. Potential energy is stored within damper 20 during −2.5° B.T.D.C. to the maximum pressure rise at +15° A.T.D.C. then returned from +15° A.T.D.C. to +65° A.T.D.C. indicated by Pos. 1. By response of piston 11, the engine 5 is held below the detonation limit using 15 to 1 C.R., as was shown by curve 2. The combustion time to the end of the rapid pressure rise was from spark −15° to +5° A.T.D.C. or 20 crank degrees during the period of rapid pressure rise. Curve 4 is taken at a lower R.P.M. than curve 3. The lower R.P.M. causes the piston 11 to respond early at 7° B.T.D.C. because the 300 P.S.I. response pressure would take place at 7° B.T.D.C. as compared to 2.5° with curve 3. The C.R. would be lower than 15 to 1 by an amount equal to the engine piston 10 displacement between T.D.C. and −7° B.T.D.C. This displacement would be added to the fixed combustion chamber displacement to calculate the C.R. This further avoids detonation with the maximum pressure rise taking place near 50° A.T.D.C. having near the same effect as retarding the spark in a conventional engine.

Curve 1-B shows the typical engine curve at 9 to 1 C.R. at near normal load and R.P.M. with the engine conditions the same as curve 1-A.

Curve 3-B shows the engine at normal load and R.P.M. with the same conditions as curve 3-A. Combustion time is 25 crank degrees. Curve 1-B should be compared with curve 3-B for indication of gain in power and fuel efficiency of curve 3-B over 1-B.

Curve 5 shows engine 5 at light loads and idling with no load showing no response from piston 11.

By comparing curve 1-A with curve 3-A the gain in power and fuel efficiency is shown first by the energy stored during the combustion time being returned to piston 10 after maximum pressure rise, indicated by the vertical hatching, and second during the period of rapid pressure rise indicated by the horizontal hatching. Pressure loss is shown between curve 3-A due to the high C.R. (15 to 1 compared with 9 to 1) and curve 1-A, as indicated by the 45 hatching. A small loss is shown due to the lower maximum cylinder pressure of curve 3-A and is also indicated by the 45°0 hatching. Other comparisons should be made between curve 1-A and curve 3-A such as piston motion A.T.D.C.

Curve 1-A would add nearly 2.5 cubic inches to the combustion chamber from T.D.C. to +25° A.T.D.C. due to piston motion.

Very little engine piston motion takes place as seen by curve 3-A from T.D.C. to 5° A.T.D.C., and 1.5 cubic inches is added to the combustion chamber by the piston 11 motion. Additional piston motion from engine piston 10 from 5° A.T.D.C. to near 15° A.T.D.C. equals one cubic inch displacement. The total piston motion after T.D.C. shown by curve 3-A is then: piston 22 motion = 1.5 cubic inches + engine piston motion = 1 cubic inch = 2.5 cubic inches, therefore no power loss takes place as seen by curve 3-A due to extra piston motion. At normal loads as shown by curve 3-B less piston motion would take place than that shown by curve 1-B, and combustion time is reduced (1-B = 50° / 3-B = 25°).

The fixed geometry of combustion chamber 16 causes very rapid pressure rise from 2.5° B.T.D.C. to 5° A.T.D.C. by the squish chamber 16-A in combination with the rapid response of piston 11 and without the use of such, curve 3-A would follow curve 2 to where the first response of piston 11 takes place, then curve to the right in much the same manner as indicated by curve 6. Therefore a considerable gain is made from using the squished chamber.

The valve 30 is preset to release near the detonation limit of engine 5. When the pressure of combustion chamber 16 exceeds the predicted detonation pressure, valve 30 will bypass the oil medium 47 in part, thus allowing piston 11 to move further within cylinder 11-A. This enlarges the fixed combustion chamber until oil can be replaced to cylinder 13 by way of line 27. The time required to replace oil 47 would be determined by the pressure within line 27 and the diameter of the line 27 or an orifice leading to cylinder 13.

To make the invention the parts could be casted or fabricated from state of the art alloys then machined to the proper tolerance and assembled according to the drawings and written descriptions.

The pressures and crank degrees shown by FIG. 6 are used to hypothetically illustrate the effects of the invention and should not me limited to the exact pressure or time as is shown, that the compression ratios may be lower or high than that illustrated and that the parts of the invention may be substituted or located by different means and locations with departing from the true spirit of the invention.

Having then described my invention, what I claim as new therein and desire to secure by letter patent is:

1. An internal combustion engine having a variable compression ratio comprising:

a power cylinder with an engine piston connected to a crankshaft, said cylinder having a head, a head cylinder in said power cylinder head comprising a compensator cylinder adjacent said power cylinder which is connected by a seat to a larger displacement cylinder, a hollow compensator piston having a base with a seat, and slidable within said cylinder so that said seats can contact each other, said base having inlet and outlet holes for circulating cooling oil through said compensator piston, said compensator piston having oil rings at either end, a first set of inlet and outlet oil lines opening into said displacement cylinder and adjacent to said head cylinder seat to as to communicate with said inlet and outlet holes, with said inlet line opening facing said inlet hole and outlet line opening facing said outlet hole.

2. The internal combustion engine according to claim 1, further comprising:

a groove around said base in which said holes are located.

3. The internal combustion engine according to claim 1, further comprising:

means for absorbing shocks to said compensator piston from combustion in said power cylinder.

4. The internal combustion engine according to claim 3, wherein said shock absorbing means includes:

a gas filled damper hydraulically linked by oil to said displacement cylinder.

5. The internal combustion engine according to claim 4, wherein said shock absorbing means further comprises a second set of inlet and outlet lines opening into a passage defining said hydraulic link, check valves in said inlet lines, a pressure relief valve in said second outlet lin for opening to release oil in said link when the pressure in said power cylinder nears the detonation limit of said engine.

6. The internal combustion engine according to claim 5, further comprising:

a check valve and a solenoid operated on-off valve in said first outlet line, a solenoid operated on-off valve in said second inlet line, and a solenoid for selectively opening said relief valve.

7. The internal combustion engine as claimed in claim 3 where said shock absorbing means further includes:

a damper hydraulically linked by oil to said first set of inlet and outlet lines to communicate between said compensator piston seat and said head cylinder seat.

8. The internal combustion engine according to claim 1, further comprising:

a baffle in said compensator piston which directs circulating oil from the base to the end of the compensator piston adjacent said power cylinder, and back again.

9. The internal combustion engine according to claim 1, wherein said power piston comprises:

a first concave portion and an adjacent smaller second concave portion, a raised segment between said portions, whereby when said power piston is at top dead center, said first portion is located opposite said compensator piston and a spark plug and forming a first chamber, said second position is located opposite an exhaust valve and forming a smaller squish chamber.

* * * * *